US009534496B1

(12) United States Patent
Ghavami

(10) Patent No.: US 9,534,496 B1
(45) Date of Patent: Jan. 3, 2017

(54) SYSTEM AND METHOD FOR TUNNEL AIR VENTILATION

(71) Applicant: Ahmadreza Ghavami, Kirkland, WA (US)

(72) Inventor: Ahmadreza Ghavami, Kirkland, WA (US)

(73) Assignee: Ahmadreza Ghavami, Kirkland, WA (US)

( * ) Notice: Subject to any disclaimer, the term of this patent is extended or adjusted under 35 U.S.C. 154(b) by 0 days.

(21) Appl. No.: 14/825,993

(22) Filed: Aug. 13, 2015

(51) Int. Cl.
*E21F 1/00* (2006.01)

(52) U.S. Cl.
CPC ..... *E21F 1/003* (2013.01)

(58) Field of Classification Search
CPC ..... E21F 1/00; E21F 1/003; E21F 1/04; E21F 1/006
USPC ..... 454/167, 168
See application file for complete search history.

(56) References Cited

U.S. PATENT DOCUMENTS 1,728,493 A * 9/1929 Kessler ..... E21F 1/003 454/167
1,731,289 A * 10/1929 Blair ..... E21F 1/003 34/223
2,427,075 A * 9/1947 Singstad ..... E21F 1/003 454/167
3,064,549 A * 11/1962 John Newton Kenneth ..... B08B 15/005 454/167
3,289,567 A * 12/1966 Renner ..... E21F 1/04 454/172
5,113,696 A 5/1992 Mole
5,518,448 A * 5/1996 Madoglio ..... B60H 1/247 454/108
5,722,885 A * 3/1998 Matthews ..... E21F 1/003 454/167
6,478,672 B1 * 11/2002 Ewald ..... A62C 3/0221 454/167
6,669,552 B1 * 12/2003 Beer ..... E21F 1/04 454/171
8,667,817 B2 3/2014 Smith et al.
2008/0160898 A1 * 7/2008 Pfannenberg ..... F04D 25/12 454/184
2011/0275302 A1 * 11/2011 Tarada ..... A62C 3/0221 454/166
2013/0012116 A1 * 1/2013 Kiyohara ..... B60H 3/0071 454/156
2013/0137356 A1 * 5/2013 Pavetic ..... E21F 1/08 454/167

* cited by examiner

*Primary Examiner* — Steven B McAllister
*Assistant Examiner* — Jonathan Cotov
(74) *Attorney, Agent, or Firm* — MaxValueIP LLC

(57) ABSTRACT

In one example, we describe a method and system for Tunnel Air Ventilation, which is very practical, economical, and easy to install or implement. The repair and maintenance is safer and less expensive. The overall cost of installation and repair is lower. The system is more stable, and thus, safer for the vehicles and people. It is not damaged by sand, and it does not cause damage to vehicles by sand. So, the risk is minimized. The overall value for the government and society is very high. The efficiency and low down time translates to a cleaner air in the tunnel, which is a major health issue for people, which causes sickness and even death for pollution and toxicity, or by fatal accidents in the tunnel, due to intoxication of the drivers or dizziness. Different variations are also discussed and shown.

17 Claims, 16 Drawing Sheets

SYSTEM AND METHOD FOR TUNNEL AIR VENTILATION

BACKGROUND OF THE INVENTION

For the past few decades, the important subject of the tunnel air ventilation (for elimination or minimizing the internal pollutions) has been mostly done by similar conventional methods. That is, the current standards of operation have remained the same and intact. This made the illusion that there were no other ways to solve this problem. The basis of the named method is (and has been) using the ceiling type jet fans, using precise calculations, for capacities and power, which are calculated and selected in accordance to numerous different factors.

The designer, who makes the various calculations and designs, should pay close attention to many different factors, some of which are (the most important ones):

1—Physical aspect of tunnel (length, section, type, directions, mechanical specifications, and the like).

2—Direction and velocity of the wind pressure, speed and direction of the changing wind patterns, and total force of wind energy.

3—Local facilities and availability of power source.

4—The current survey information, such as type of fuel, total consumption of fuels, especially on weekends, and at last, total weight and volume of pollutant that is produced by the cars passing through the tunnel in a 24-hour period, or a fixed amount of time.

5—Approximate separation of the pollutant materials (both physical and chemical, as well as for gases). (Pollution graphical curves showing increasing or decreasing of pollution throughout different times of the day and the weather conditions, and also showing the minimum need for vehicles and people, for using oxygen during the time, while traveling inside of the tunnel.)

6—Bringing attention to all above items and also to the recommendations and technical orders of jet-fans manufacturers. And lastly, the former experiences of similar and past projects, numbers, air capacity, power, and distances (of jet-fans from one another) are examined.

These procedures are normally done and repeated for most of the tunnels, and final result would be selection of a chain of jet-fans placed in the ceiling of the tunnel, in one or two longitudinal axis having certain distances from one another, which draws in the fresh air from one mouth of the tunnel, to the next mouth of it. This is a constant and continuous procedure. This chain of operation is done along the total length of the tunnel and moves the contaminants out of it.

Following are some brief descriptions of disadvantages, weak points, and operational difficulties of Jet-Fan Systems/the conventional system in use today:

1—Financial needs of the system for heavy investment.

2—Substantial weight of the ceiling type jet fans, especially for double type fans, and the cost of special steel hangers.

3—Most importantly, since jet fans operate in chain formation, there are constantly and heavily working and depending on one another. Considering this fact, if one or two units in the chain are inoperable, it will create an operational gap within the system. Additionally, it has a negative effect on the safe and correct chain operation.

4—The Jet-Fan fan system needs a huge amount of cabling, and huge consumption of power, for both normal and backup supplies. The automatic system for the chain has also a complicated wiring network.

5—The system needs to maintain the electrical consumption for the units, which relates to the average consumption of each unit. The total consumption is substantial and the chain needs a high voltage transfer station for itself and its network. Therefore, the running cost of energy consumptions during the years of usage will accumulate to a very large number for the users.

6—Different tunnels are in need of different spare parts, that need substantial budget for different kinds and models, upkeep of units, storage, and operation.

7—Need for clear and precise warranties and specifications and manufacturer guarantees of part's operational integrity. More so, there is a need for higher level of technical skilled labors, which translates into higher wages and thus, bigger annual budgets.

8—A higher level of noise pollution within the tunnel and higher reflectance of sound during operation of the jet-fans (all encompassing).

9—There are limitations within the unit's inspection, maintenance, set-up, and repair of different pieces that may cause temporary shutdown to the tunnel and traffic built-up, which is very costly to public and economy, or sometimes impractical to stop the traffic at all, making the repairs within tunnel impossible or very dangerous for the crew.

10—Since the ceiling fans are hanging from a cement and stone foundations, and they may become loose after a while, due to earth movements or vibration of the fans, there are hidden and probable danger factors from the weight and the vibration of the units (to fall on a vehicle, causing major damages/accidents or death to passengers).

The effect above can be even higher, if the frequency of rotation of all the fans matches the resonant frequency of a principal length or portion or component of the tunnel, which can be an unstable system, with vibrations, with growing amplitude, with increasing the amplitude very quickly. This will cause the whole system collapses, making it very dangerous for people and cars in the tunnel at that time.

11—There are considerable cost and change of designs, plus additional problems, if the design and construction of the chain fan system in some cases are incorrect, to re-do the whole system from scratch again.

12—Special consideration should be given to the pollutant in some countries mixed with the bits of desert sand. The Jet-Fan system has no filtration capabilities, causing the sand to fly like a bullet from the fan blade, with high speed, which can damage the cars seriously and can kill the people upon impact. In addition, designing filters for tunnel air ventilation system is not an easy task. The chain system will not purify the pollutant found in the air and acts as a vacuum.

However, the invention and embodiments described here, below, solve all these problems, and they have not been addressed or presented, in any prior art.

SUMMARY OF THE INVENTION

In one embodiment, we describe a method and system for Tunnel Air Ventilation, which is very practical, economical, and easy to install or implement. The repair and maintenance is safer and less expensive. The overall cost of installation and repair is lower. The system is more stable, and thus, safer for the vehicles and people. It is not damaged by sand, and it does not cause damage to vehicles by sand. So, the risk is minimized. The overall value for the government and society is very high. The efficiency and low down time translates to a cleaner air in the tunnel, which is a major health issue for people, which causes sickness and even death for pollution and toxicity, or by fatal accidents in the tunnel, due to intoxication of the drivers or dizziness. The short term and long term effects on the health of drivers and passengers are huge, especially children, who are very sensitive to the polluted air or toxins, or for people with asthma or allergy, which can be fatal. Thus, our system and method can solve all these problems, with so many advantages, for millions of people around the world, and for many years to come.

DETAILED DESCRIPTION OF THE PREFERRED EMBODIMENTS

Figure 1:
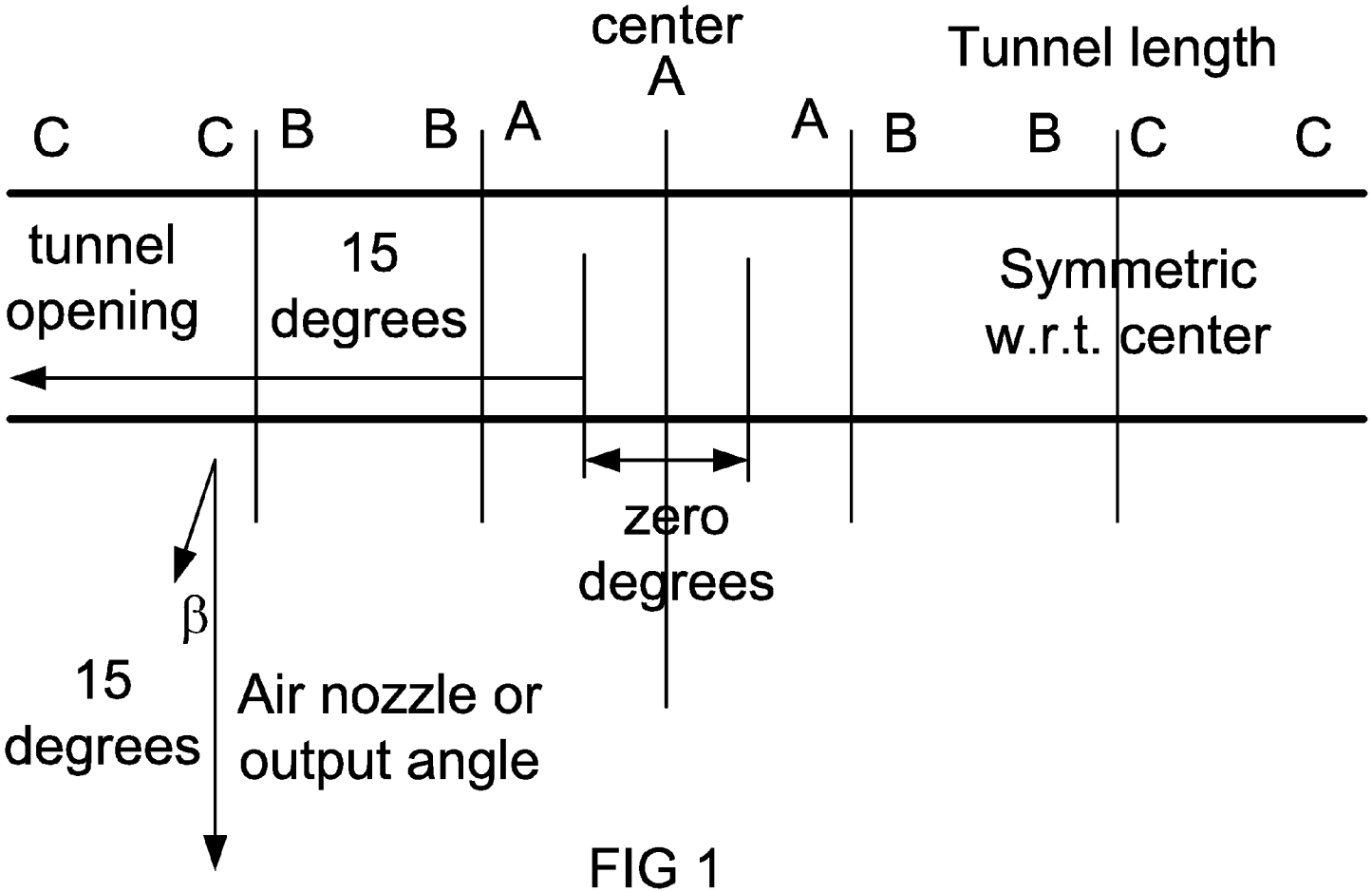
FIG. 1 shows the tunnel with various regions and air output parameters, e.g., air output angles, with symmetry w.r.t. center of the tunnel.

The current and above mentioned flaws, cost, operational inefficiency, and archaic approach to the tunnel design have motivated the inventor here to come up with a new way to design an upcoming tunnel ventilation system.

As a result, we have a new way of approach to tunnel ventilation system that is more cost effective, with considerably fewer working parts, easier repairs, as opposed to difficulty in operation and changing parts, and heavy reliance on bad and old tunnel design.

Specification, differentiation, and the explanation of the new method:

The system and method is fundamentally based upon continuous "Partial Positive Pressure" (P.P.P.), which applies to the total volume of the tunnel. In the interest to clarify the suggested subject matter, we conducted a simple experiment that can prove the functionality of the new method.

The Experiment, to show the physics of our method and system:

We have done both experiment and simulation on this model: Using a horizontal pipe, which is partially sealed at both ends (4" in diameter and 6.5' in length, or two meters), we insert dyed colored water and then use a syringe device. We introduce clean water through the middle of the pipe. The introduction of the clean water will force the dyed colored water to either side of the main pipe. The pipe, itself, acts as a representation of the tunnel and the clean water acts as the symbol of the fresh air that is purging the dyed colored liquid. The purging of the dyed colored liquid acts as the symbol of eliminatory factors of pollution. This experiment is the basic foundation of our method of tunnel ventilation. With removal of the pollution very efficiently in our experiment, we can conclude that the technique works for the real tunnels, as well, to improve the ventilation drastically.

Ventilation Method:

Observing the experiment, it is seen that using one or two medium pressured centrifugal "Air Handling Unit Equipments", each unit installed at either ends of the tunnel, located at outside tunnel, e.g. on side of mountain, and using one piece steel round section duct connecting the two equipments together, all along the length of the tunnel, make the ventilation operational for the tunnel. We will calculate and describe the specific number of diffusers amongst the length of the entire duct with certain "throwing angle of air" on certain points of the ducts, with the calculated volume of the outlet air, in an example below. Using the earlier experiment (pipe and dye water), described above, it is certain that the same basic rules and physics concepts can be applied to the real conditions for cleaning the polluted tunnel's air. The features are described in more details below.

Strengths of Our Method:

1—One of the most important points of the method is that almost all needed parts for running the system can be made within most countries, and very economically.

2—Instead of installing heavy Jet-fans from the ceilings, which comes with some problems, as discussed before, the suggested method uses much lighter and more efficient materials, such as ducts and diffusers, which are simple to install without any danger involved. Additionally, there are no needs for special skills or extra cost involved for the installation.

3—The system is totally intertwined and moves the air perpetually through a chain of hundreds of special kind of diffusers, thus, the operation is non-stop and continues, unless there are shut down (or broken component) problems with the outside "Air Handling Units", which is much less than problems happening for Jet-fans (current) systems.

4—In comparing the Jet-Fan system to our method, it is clear that the old system (Jet-Fan) is more labor intensive, uses large amounts of expensive "anti-fire" cabling, and much more wiring (for automatic controls). Looking from these angles, our system is much simpler and much less expensive.

5—It is simply clear that the power consumption of two or four medium pressure "air handling units" (i.e., 10-12' pressure) is much less than the accumulated power consumption of 10 s of jet-fans in the current systems.

6—Mentioning the simplicity of the method, it is apparent that upkeep and storage of spare parts (as well as price) in between the two systems favors our system drastically.

7—Using our method, there are additional advantages, like simplicity to change the diffusers and possibility to change the design and preventing issues with any kind of silencer on exit path of the "air handling units". This is important because of the noise levels that are not in the same level between the two systems (i.e., Jet-Fan makes tremendous amounts of noise pollution, vs. our method, with minimal noise).

8—Our unit will need occasional maintenance, which are only from outside of the tunnel (i.e., air handling unit maintenance). There are no inside maintenance required, whatsoever, to interfere with traffic.

9—The system eliminates the need of heavy equipments within the tunnel, which cause danger and accidents.

10—The design and characteristics of the method is such that necessary design and maintenance modifications are very practical.

11—As opposed to the "jet-fan" system, which has no capability for air filtration, the method has plenty of room for filtering and eliminating most kinds of air pollutants or particles.

12—The suggested method has some similarities to the transversal method of ventilation, but, yet, it is completely different in design and details.

So, our method is superior to the conventional methods in use in industry today.

Comparison of Primary Energy Consumption Between the Two Methods:

For example, the following is the approximate assessment between the two methods, for 2000 meters in length and about 45 square meters in cross sectional area.

A) Jet Fan Method:

In accordance to the standards of calculation per (PIARC, RUSSI, ASHRAE, or the like), the Jet-Fan system needs about 30 pairs of duplex fans (or 60 single fans), in distances of approximately 70 meters apart. Each fan uses about 37 KW in power consumption, and therefore, about 2220 KWs of electricity consumption in total for all fans.

B) Our Method:

According to similar calculations, in case of using our method, we need the following items:

Four "Air Handling" units, type "Airfoil".

Each unit with capacity of 80,000-100,000 C.F.M. (cubic foot per minute).

10,000-12,000 SQ meters of spiral duct

About 150 boxes of air supply register.

About 1500 aerodynamic horns for air supply inside of the tunnel

The individual power consumption of each air handling unit is about 75 KW, and 300 KW is the total consumption, which is much less than 2220 KW for the other method, mentioned above. So, our method is much more superior to prior art, in terms of power consumption and usage (or cost of usage or efficiency of operation).

One example for tunnel design:

The width of the opening is about 8.5 m, with the height of 7.5 m, and cross section of about 55 to 60 $m^2$, with 3 lanes, with length of 1 km, and slope of 2.5 percent, maximum. We inject 100,000-200,000 CFM of fresh air into tunnel, depending on the degree of pollution and toxicity in the tunnel. We use the galvanized steel ducts and canals (Spiro Duct type) all along tunnel, under the roof, between the 2 openings of the tunnel, with diameter of about 48 inches.

The distribution of fresh air comes from the main duct (or pipe or canal) all along the tunnel through about 144 points of exit. The exit or distribution points are divided into 3 categories, as an example, with a shape of funnel or trumpet or horn at the end: 3-end units; 5-end units; and 7-end units. Other variations can be done, e.g., with even numbers. Thus, we have 780-800 end units of Al material, as example. Other materials or alloys or plastic or metals or wood or elastic can be used, as well. Nozzle shape or spray shape ending or shower head shape ending can be used, as well. Each end unit has about 255 CFM output, which is about 120 liter/sec, with exit speed of about 2100 FPM, or feet/min, or about 10.67 m/s. Generally, 7-end units are for dirty areas or locations.

The main duct (or pipe or canal) is divided into multiple sections, as example:

Region AAAA in the middle region: distance between exit points: about 5 meters. About 20 end units. Perpendicular direction with respect to the axis of the tunnel. Alpha1 angle=0. Note that 7-end units are used.

Region side of the center or middle region: region BBBB: distance between exit points: about 7.5 meters. The direction of the funnels: about 15 degrees off axis with respect to those in the middle of the tunnel. Alpha2 angle=15 degrees. Note that 5-end units are used.

Region at the 2 ends of tunnel: region CCCC: distance between exit points: about 10 meters. The direction of the funnels: about 15 degrees off axis with respect to those in the middle of the tunnel. Alpha3 angle=about 15 degrees. Note that 3-end units are used, which has less pollution and particles/unit volume.

Note that, in the middle, in general, Alpha1 angle is 0 or near zero, and it gradually increases to 15-20 degrees, as it approaches the ends of the tunnel from both sides. This is more efficient in terms of circulating the good air in, and getting the bad air out fast and with less energy consumption.

The following is some examples or embodiments: At the 2 ends of the tunnel, outside the tunnel, we install 2 fans or sets of fans, with filter to get the sand, particles, toxins, or chemicals, with each set with multiple units or fans or multiple blades, e.g., 3-5 sets of blades or fans. Each one is equipped with an inverter and controller or processor for controlling the energy consumed/used, based on the need and usage. It also has a unit for CO or CO2 gas detector or other particles, or with sensors with optical or spectrometer or other means, e.g. for toxins, for detecting and analysis, for gas or particles or chemicals. The result of analysis goes to the processor and controller to adjust the speed or opening angle or volume or cross section for fans or registers or openings, or to adjust angle of attack for fans, for position and tilt, with respect to horizontal axis or vertical plane. This will adjust the power and speed for the fans or number of fans operational or speed of fans with respect to each other, or the direction of the fans with respect to each other, or tilt of the fans with respect to each other, as relative value.

As an embodiment, each air supply system has 2 units, each with e.g. 50,000 $ft^3$/min, with a total of about 200,000

$ft^3$/min, total, maximum, in the worst case scenario, for bad quality of air. The dynamic pressure on the fan is about e.g. 12-13 inches of water column pressure, for maximum level of operation. The maximum electrical consumption is about 75 KW for each unit, and thus, about 300 KW for all the system. Each unit has an inverter, and airfoil fan blades. Each motor has a variable speed, as well as bi-directional version, i.e., turning left and turning right. Each unit has a bag (for filter for fresh air for each fan). Each unit has an anti-vibration and silencer to reduce noise or vibration.

As an embodiment, we will have about 2 CFM/$ft^2$ (cubic feet per minute, per 1 ft square of area of the floor of the tunnel) at each opening of the tunnel, for maximum displacement of air. We have total of about 200,000 $ft^3$/min. The average exchange rate of the air for the whole tunnel space is about 6-7 air changes/h. At the maximum, for injection of air, the average speed for exit from each of the tunnel openings is about 165-170 FPM (feet per minute).

We have a large series of sensors and analysis systems for CO and CO2 all along the tunnel space and length. A controller, getting feed from sensors and detectors (and a processor/computer/server), decides the operation of the fans and the units, to optimize or command or decide, e.g., for speed, direction, tilt, which unit, and which combination of fans and units are operational, per each period of time. This minimizes the pollution and particle concentrations in the tunnel, depending on traffic and concentration. So, it is flexible, dynamic, changeable, and optimized.

As an embodiment, we use the government mandate or recommendations, e.g., EPA, UN, PIARC, ASHRAE, ISAVT, local governments, and Federal rules and minimums or maximums, to control the air flow and filtering.

For example, for heavy traffic, with length of time in tunnel for each vehicle, in average, e.g., at 10-15 minutes, we set the maximum allowable concentration for health purposes as 50-75 PPM (parts per million) for all particles, as an example.

When fire happens inside tunnel, the units can reverse themselves, for exhaust for suction, against fire effects. In addition, we can add some special registers that are located along the main tube or canal, and they can be opened with spring action to help fight against fire. They are normally closed with leak proof tight cap or door or shutter. They are opened after fire detection, to suck the air out for smoke and toxic air.

As mentioned before, the Jet fan system in use today uses about e.g. 1000 KW power, whereas our system uses 300 KW for the same tunnel, for injection method, which is more than 3 times improvement on efficiency and savings in cost. For a country with many tunnels, this can add up for millions of dollars, as the extra high power towers and reducing to low power stations (as the infrastructure for the tunnels, e.g., distribution system or boxes or units) are also very expensive to install and maintain. In addition, much less cabling for power and control systems within tunnel are needed with our system, which adds to cost saving and differential or advantage for our system, for repair, installation and operation.

Also, probably, the shaking and vibration cause the fans on ceiling to get loose after a few years, without any or with low visible notice or warning, causing dangerous or fatal crashes or accidents in the tunnel, making our solution much safer, as it does not need such preventive inspections or repairs, which are very disruptive or dangerous for the traffic or repair crew. Note that our diffusers have no or little mechanical parts, with no heavy fans or motors attached to the ceilings.

Some Examples

A tunnel air ventilation system installed on a tunnel, said system comprising: two fan subsystems; wherein said two fan subsystems are located at two ends of said tunnel, outside said tunnel; wherein each of said two fan subsystems comprises: a filter, a vibration damping device, and at least one fan; a main duct; wherein said two fan subsystems comprises a first fan subsystem and a second fan subsystem; wherein said first fan subsystem is connected to said main duct; wherein said main duct stretches from a first end of said tunnel to middle of said tunnel; wherein said first fan subsystem pushes air into said main duct through length of said tunnel from said first end of said tunnel toward said middle of said tunnel; multiple outlet units; wherein said multiple outlet units are located on said main duct; wherein each of said multiple outlet units has one or more air funnels for passing air into said tunnel; wherein said tunnel is divided into three main regions; wherein said three main regions comprise:

a) first entrance region and second entrance region, b) first side region and second side region, and c) a middle tunnel region.

Wherein in said middle tunnel region, the density of number of said multiple outlet units on said main duct, per unit length of said main duct, is $D_{middle}$; wherein in said first side region, the density of number of said multiple outlet units on said main duct, per unit length of said main duct, is $D_{side}$; wherein in said first entrance region, the density of number of said multiple outlet units on said main duct, per unit length of said main duct, is $D_{entrance}$; wherein said $D_{middle}$ is larger than $D_{side}$, and said $D_{side}$ is larger than $D_{entrance}$; wherein for a first part of said middle tunnel region, located in close proximity of said middle of said tunnel, said one or more air funnels are positioned perpendicular to said tunnel's length axis; and wherein for any parts of said tunnel other than said first part of said middle tunnel region, said one or more air funnels are positioned inclined with respect to said perpendicular to said tunnel's length axis, pointing toward either said first end of said tunnel or a second end of said tunnel which is closer to said one or more air funnels.

The tunnel air ventilation system installed on a tunnel, said system comprising:

a hinge, located on each of said multiple outlet units.

wherein said filter is a fine filter.

wherein said filter is a coarse filter.

wherein said filter is a particle filter.

wherein said filter is a sand filter.

wherein said filter is a chemical filter.

wherein said filter is a toxin filter.

wherein said system is symmetric with respect to center of said tunnel.

wherein said system is un-symmetric with respect to center of said tunnel.

wherein said at least one fan is two or more fans.

wherein said one or more air funnels are 3 funnels.

wherein said one or more air funnels are 5 funnels.

wherein said one or more air funnels are 7 funnels.

wherein said one or more air funnels are odd number of funnels.

wherein said one or more air funnels are even number of funnels.

wherein said one or more air funnels have same directions.

wherein said one or more air funnels have different directions.

wherein said one or more air funnels have a shutter.

wherein said one or more air funnels are made of plastic, metal, or alloy.

Some Examples

Figure 2:
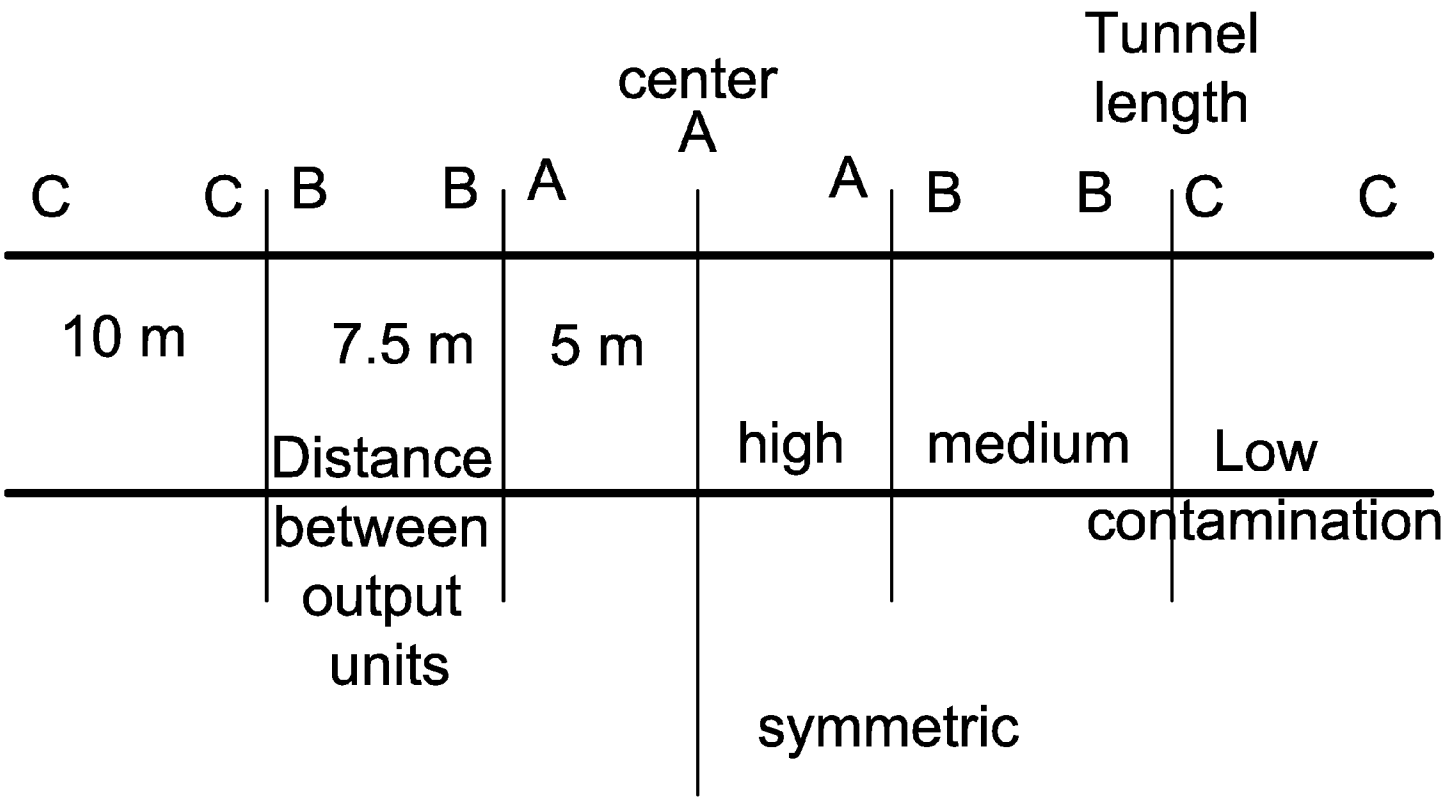
FIG. 2 shows the tunnel with various regions and their parameters, e.g., distance between units and level of contamination, which is usually worse in the middle of the tunnel.
Figure 3:
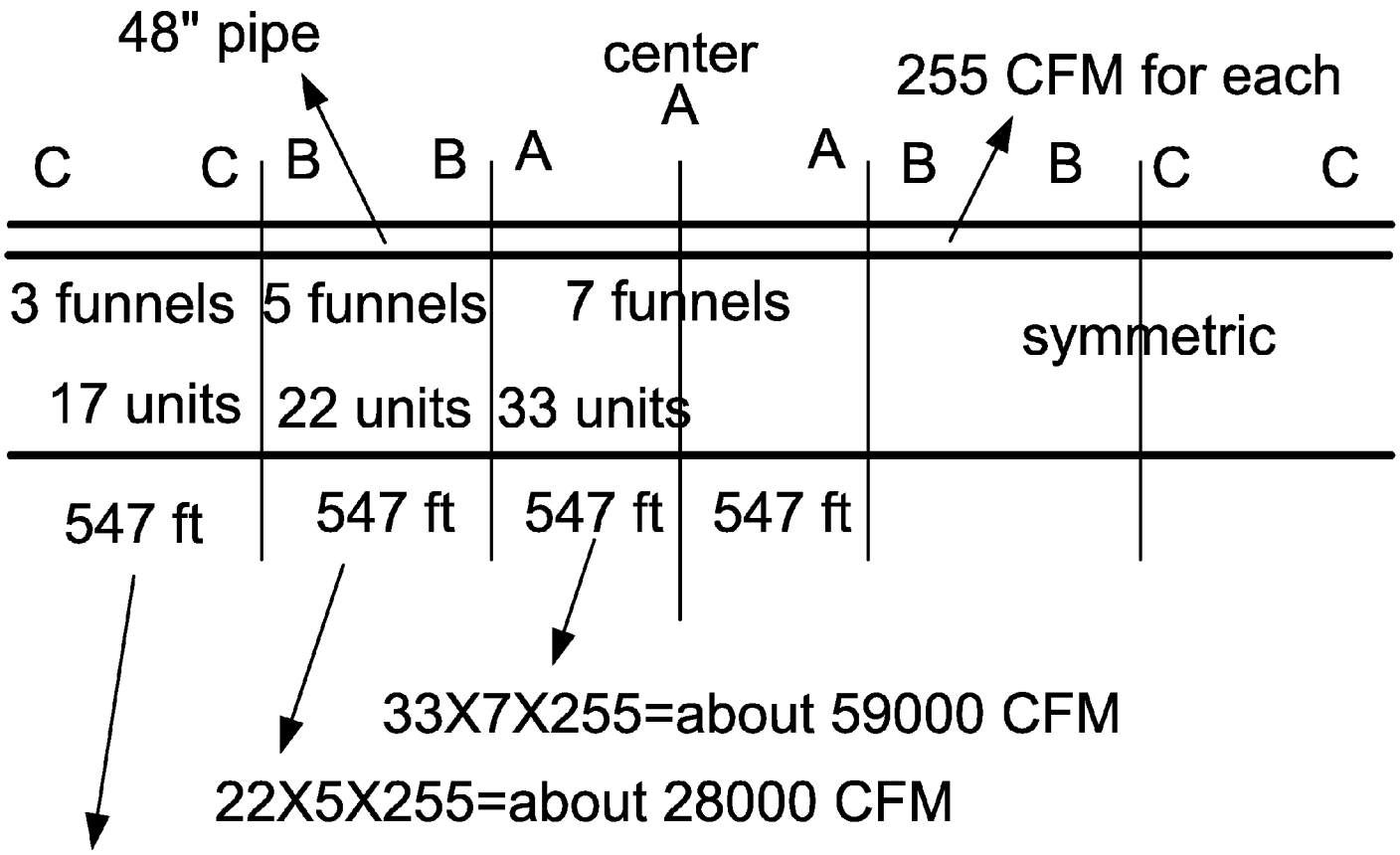
FIG. 3 shows the tunnel with various regions and air output parameters, e.g., number of units and number of funnels per unit, as well as some example dimensions, and CFM output for air coming out.

FIG. 1 shows the tunnel with various regions and air output parameters, e.g., air output angles, with symmetry w.r.t. center of the tunnel. FIG. 2 shows the tunnel with various regions and their parameters, e.g., distance between units and level of contamination, which is usually worse in the middle of the tunnel. FIG. 3 shows the tunnel with various regions and air output parameters, e.g., number of units and number of funnels per unit, as well as some example dimensions, and CFM output for air coming out.

Figure 4:
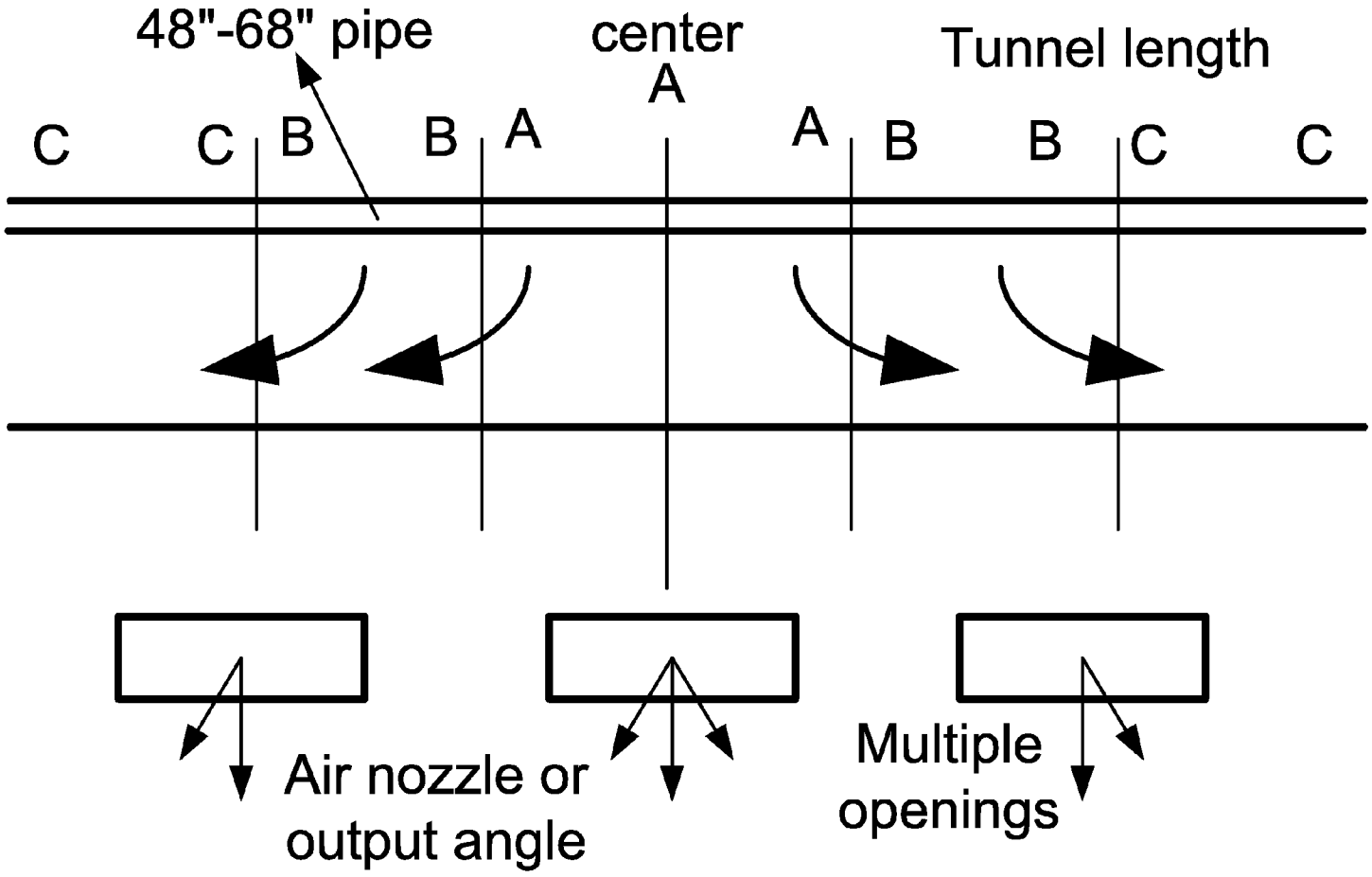
FIG. 4 shows the tunnel with various regions and air output parameters, e.g., nozzle directions and air flow directions.
Figure 5:
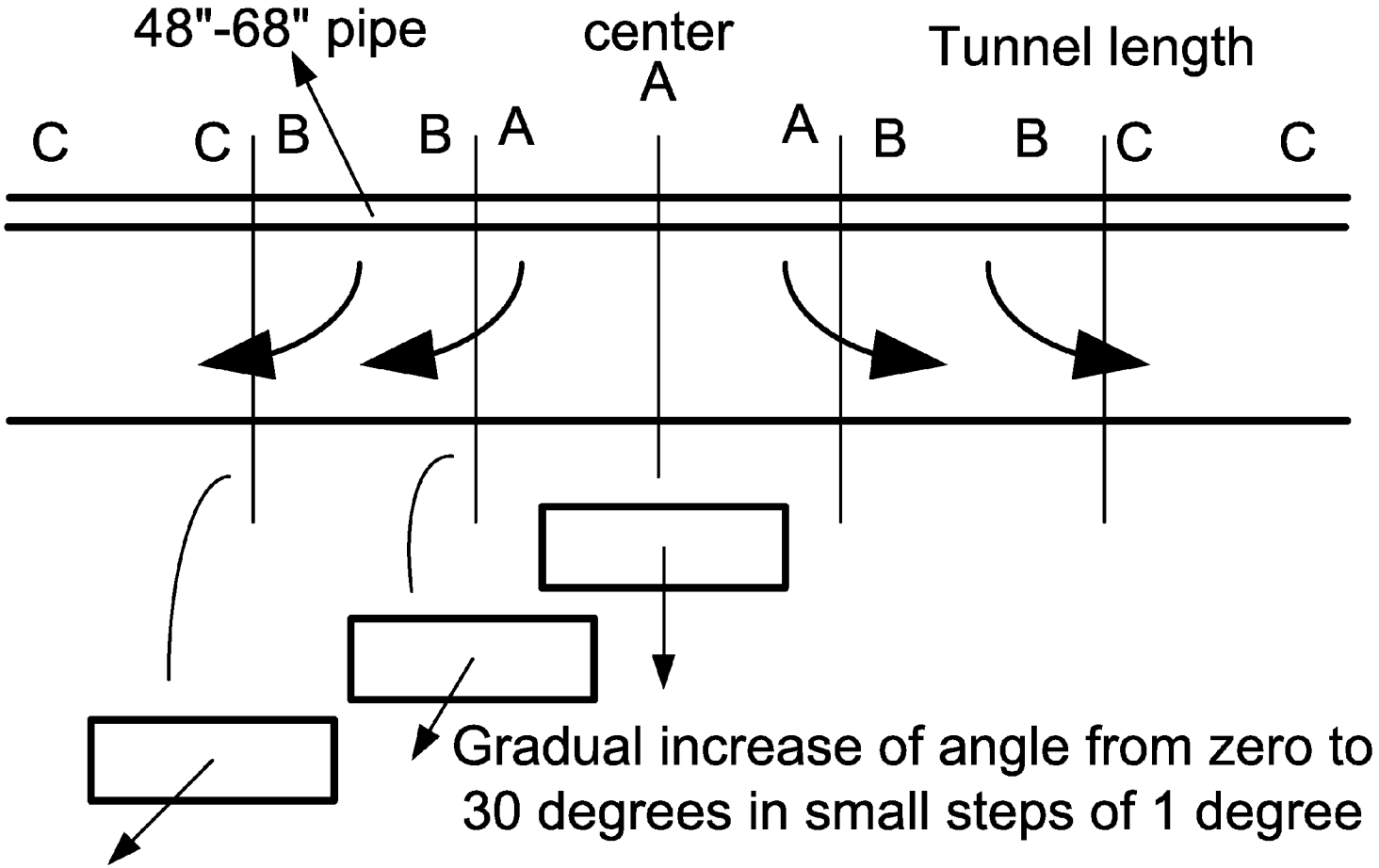
FIG. 5 shows the tunnel with various regions and air output parameters, e.g., nozzle directions and air flow directions, with gradual increase on angle.
Figure 6:
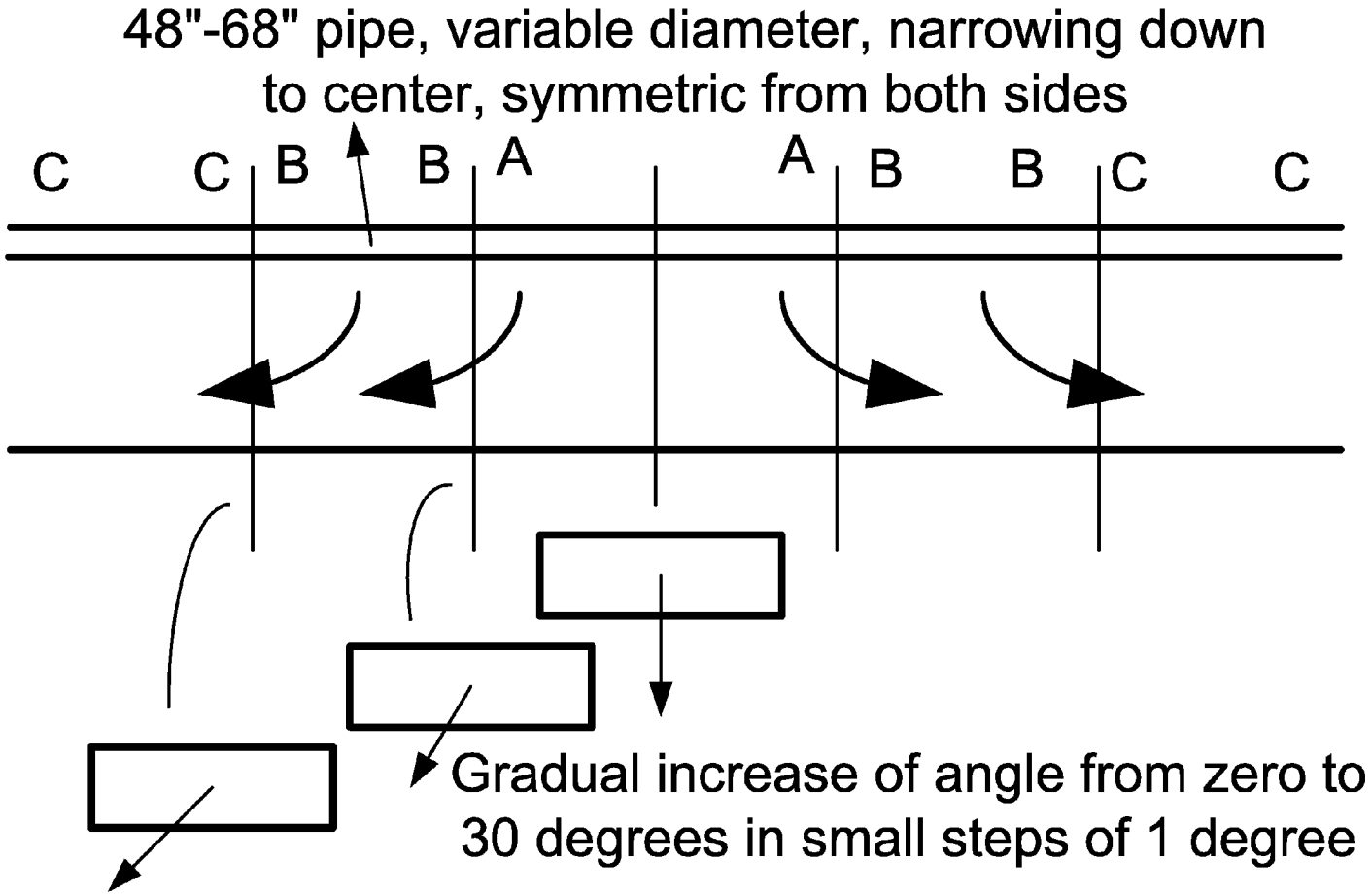
FIG. 6 shows the tunnel with various regions and air output parameters, e.g., nozzle directions and air flow directions, with gradual increase on angle, with variable diameter of main duct (or pipe or canal).
Figure 7:
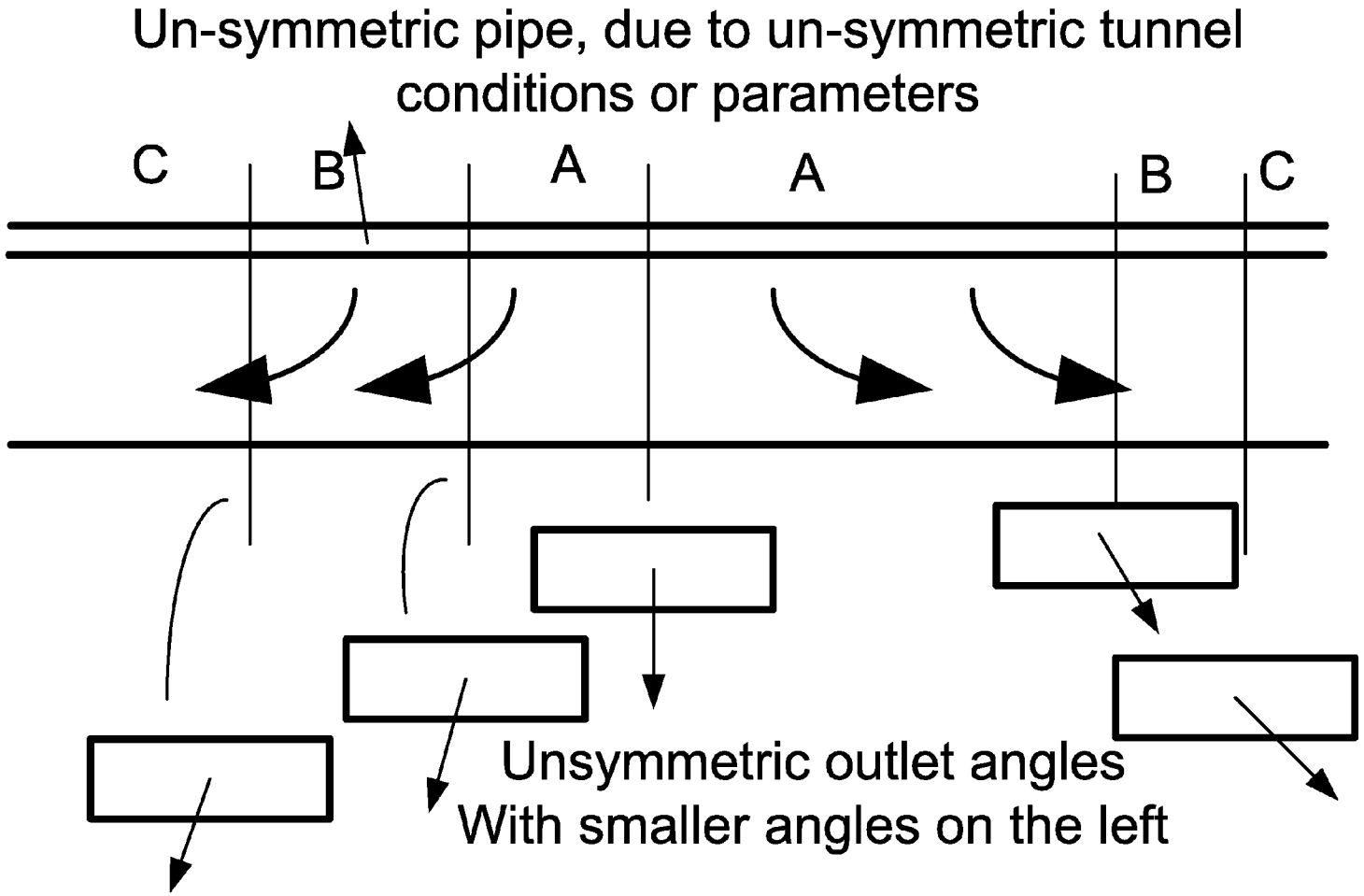
FIG. 7 shows the tunnel with various regions and air output parameters, with unsymmetric structure and parameters.

FIG. 4 shows the tunnel with various regions and air output parameters, e.g., nozzle directions and air flow directions. FIG. 5 shows the tunnel with various regions and air output parameters, e.g., nozzle directions and air flow directions, with gradual increase on angle. FIG. 6 shows the tunnel with various regions and air output parameters, e.g., nozzle directions and air flow directions, with gradual increase on angle, with variable diameter of main duct (or pipe or canal). FIG. 7 shows the tunnel with various regions and air output parameters, with unsymmetric structure and parameters.

Figure 8:
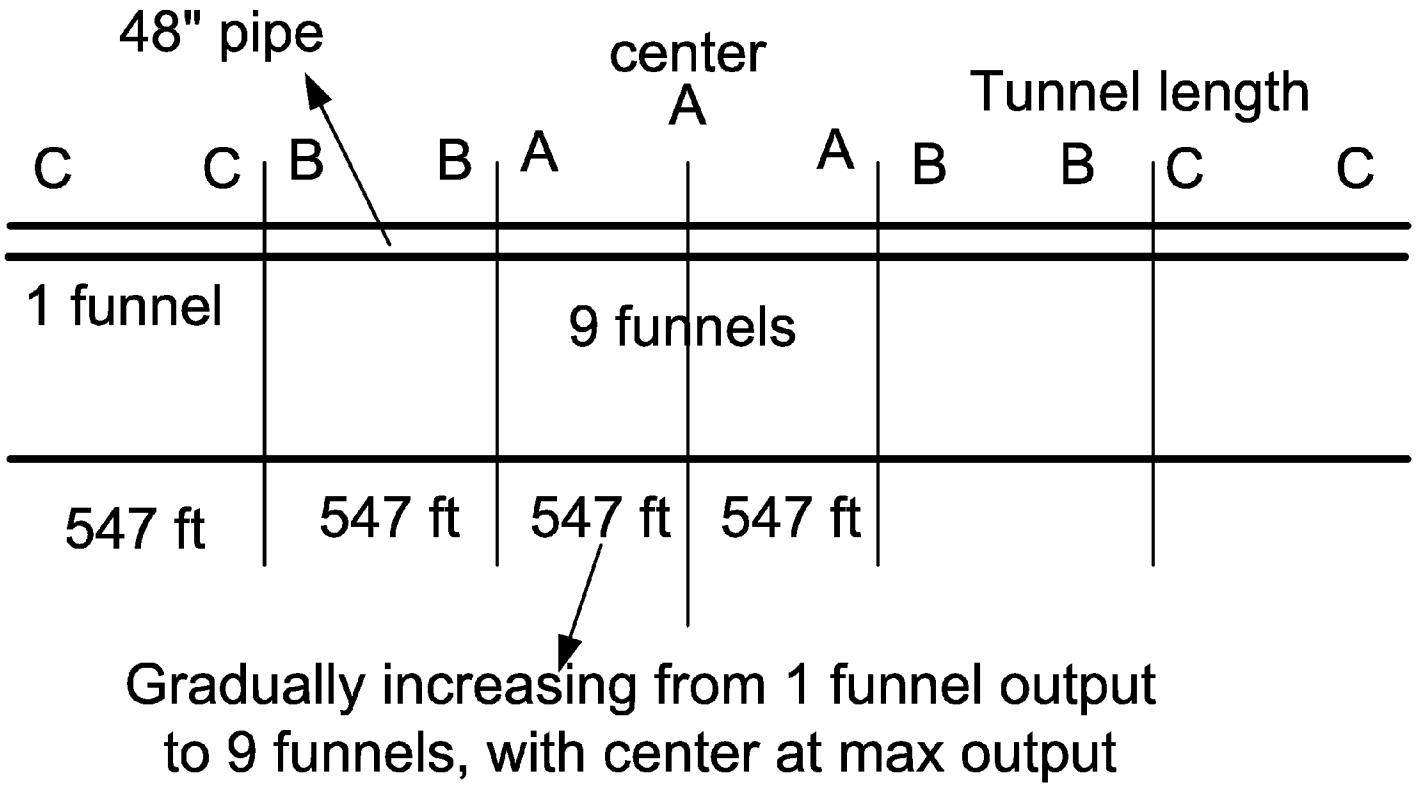
FIG. 8 shows the tunnel with various regions and air output parameters, with variable number of funnels per unit.
Figure 9:
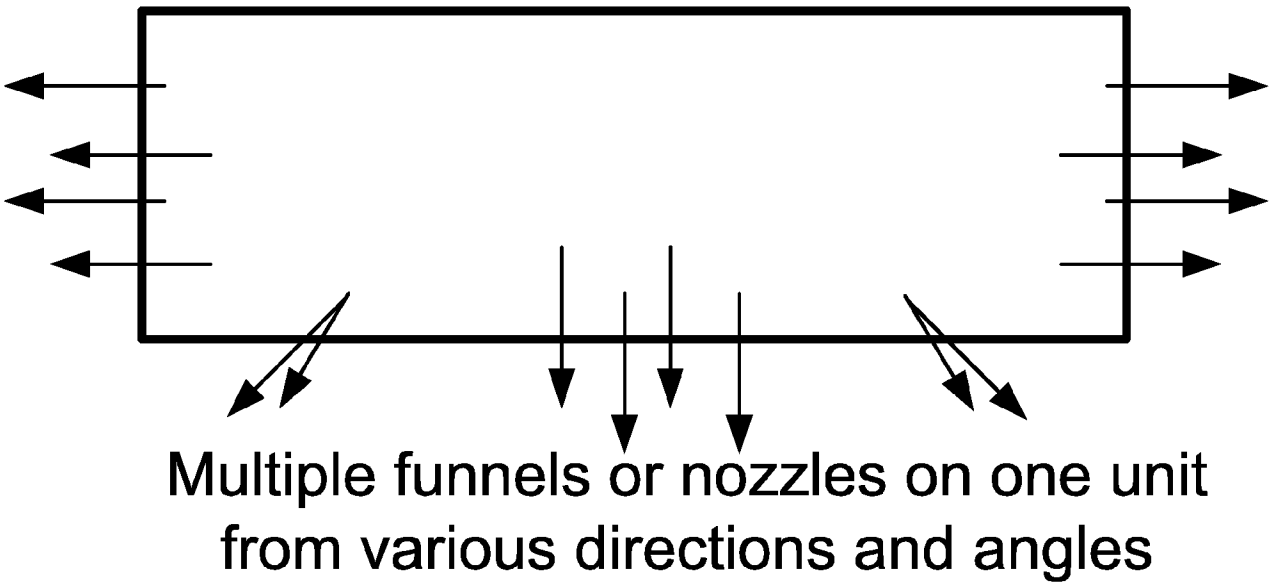
FIG. 9 shows the outlet unit with various nozzles in various directions.
Figure 10:
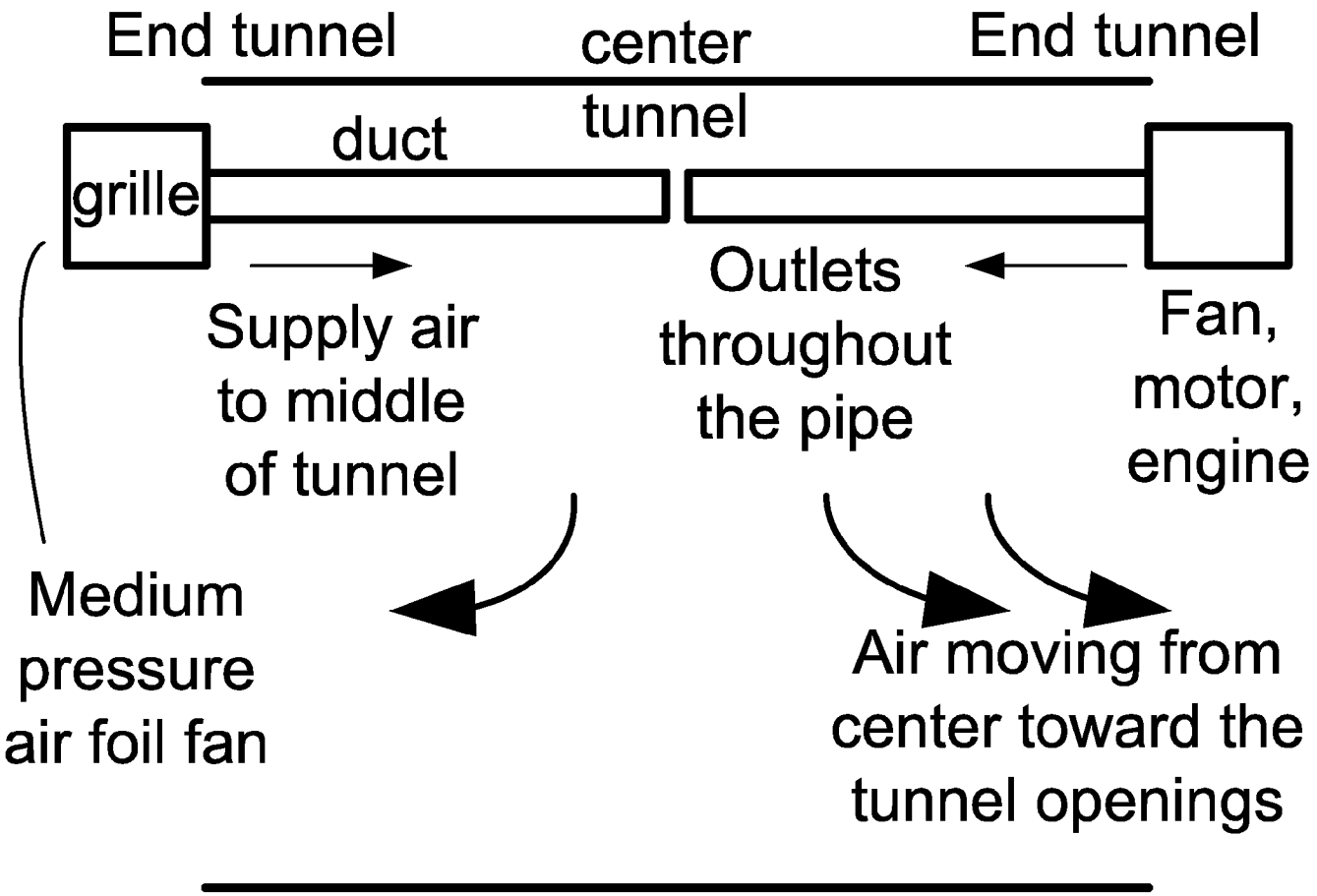
FIG. 10 shows the tunnel with 2 fan systems at the 2 ends outside tunnel sending the air to the middle for circulation back out through the 2 entrances of the tunnel, from both sides, through the main ducts (or pipe or canal) from both ends.

FIG. 8 shows the tunnel with various regions and air output parameters, with variable number of funnels per unit. FIG. 9 shows the outlet unit with various nozzles in various directions. FIG. 10 shows the tunnel with 2 fan systems at the 2 ends outside tunnel sending the air to the middle for circulation back out through the 2 entrances of the tunnel, from both sides, through the main ducts (or pipes or canals) from both ends.

Figure 11:
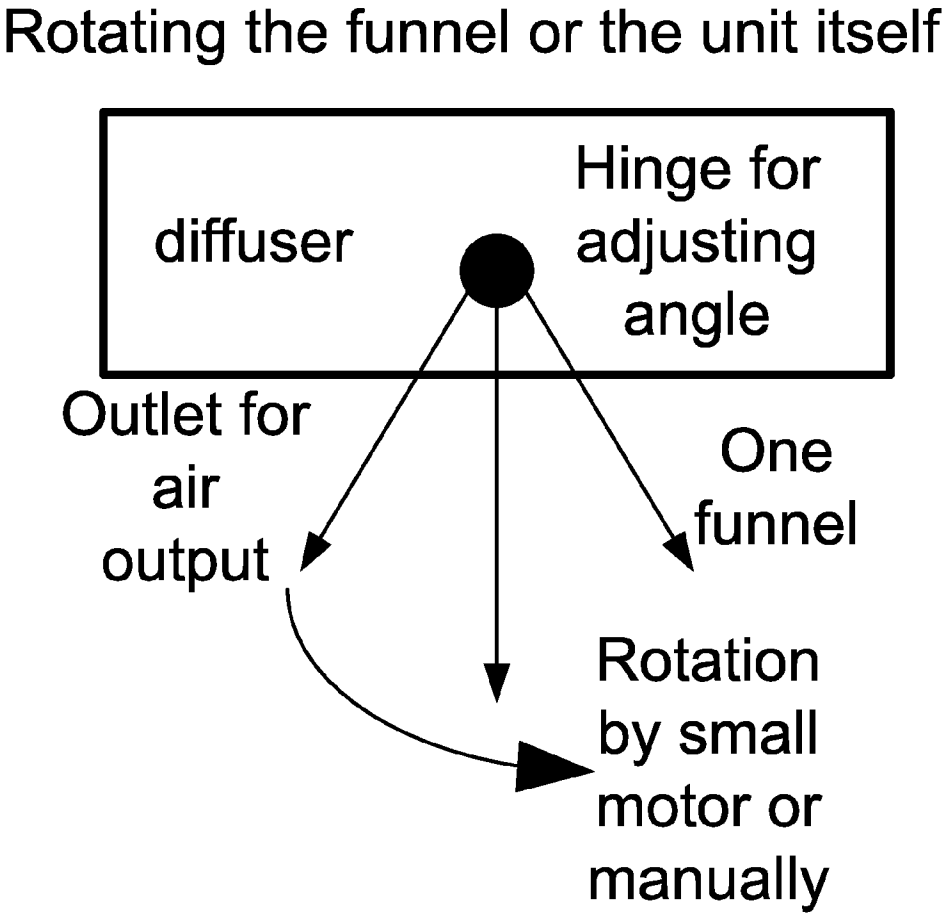
FIG. 11 shows the funnel with various angles with hinge on a unit.
Figure 12:
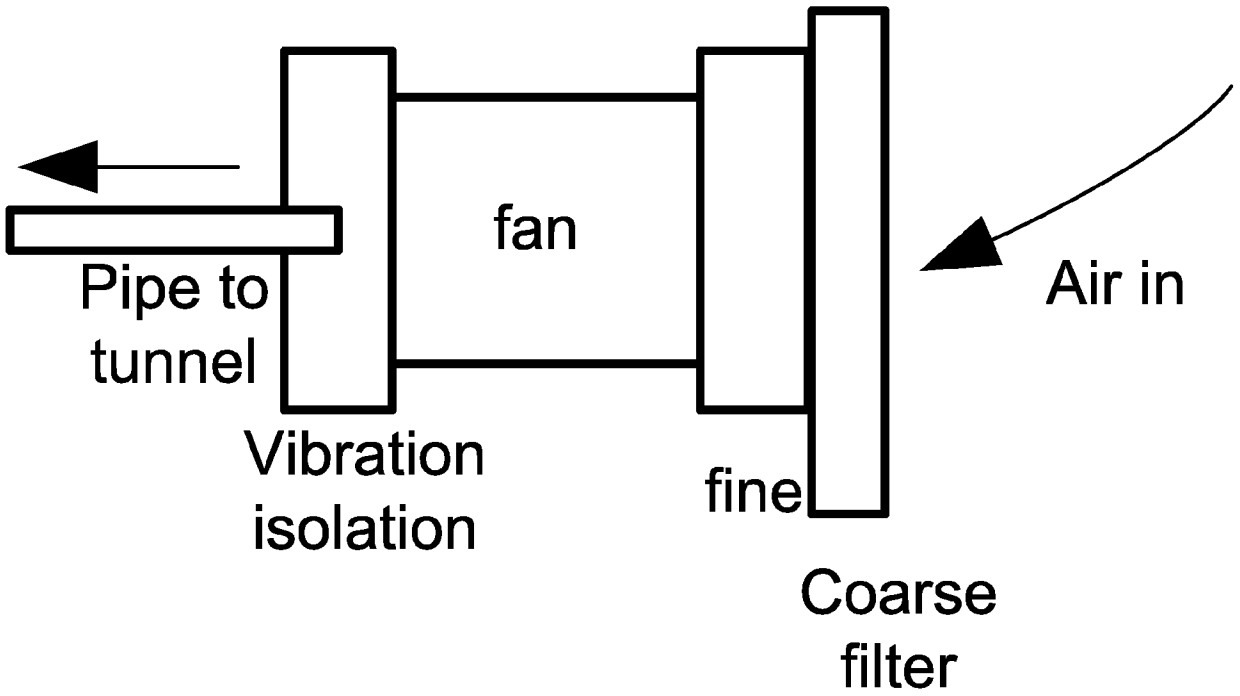
FIG. 12 shows the fan with various filters for particles, with soft bed vibration isolator at the end, for the duct (or pipe or canal) to the tunnel.
Figure 13:
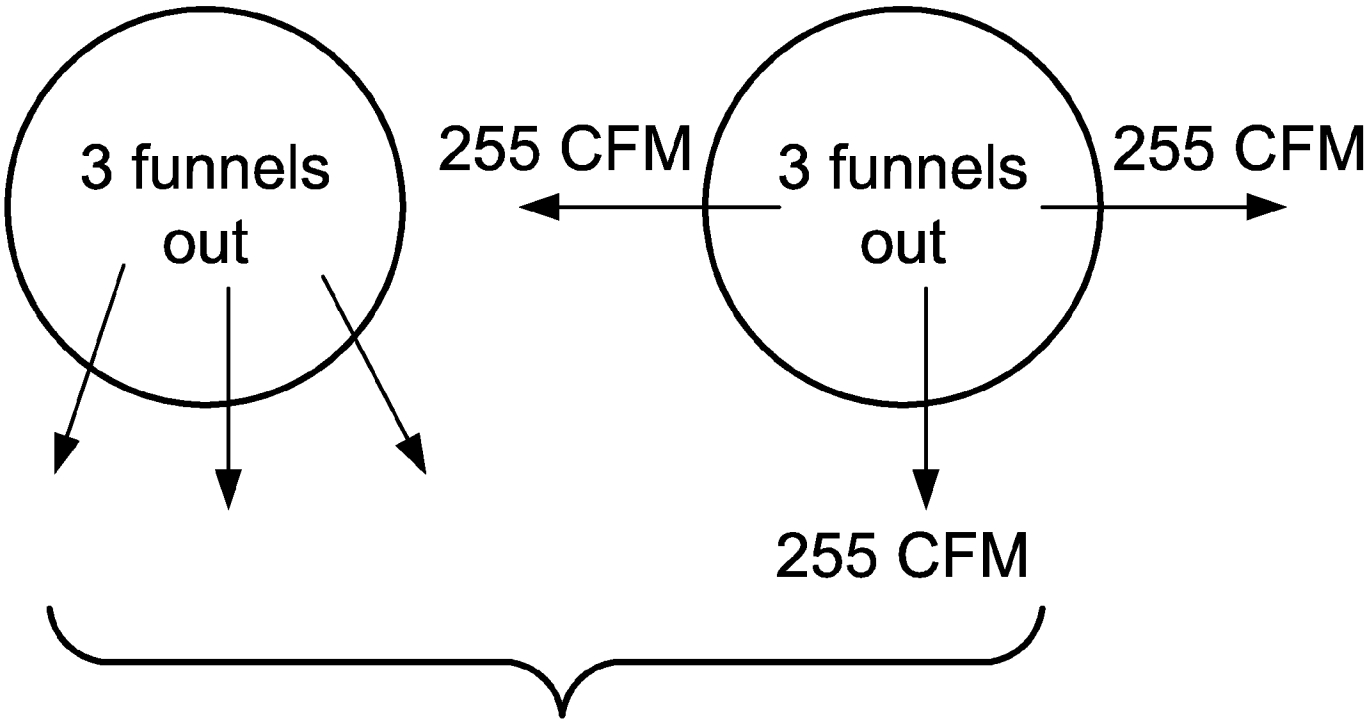
FIG. 13 shows the funnels with various angles, with 3 funnels on a unit.
Figure 14:
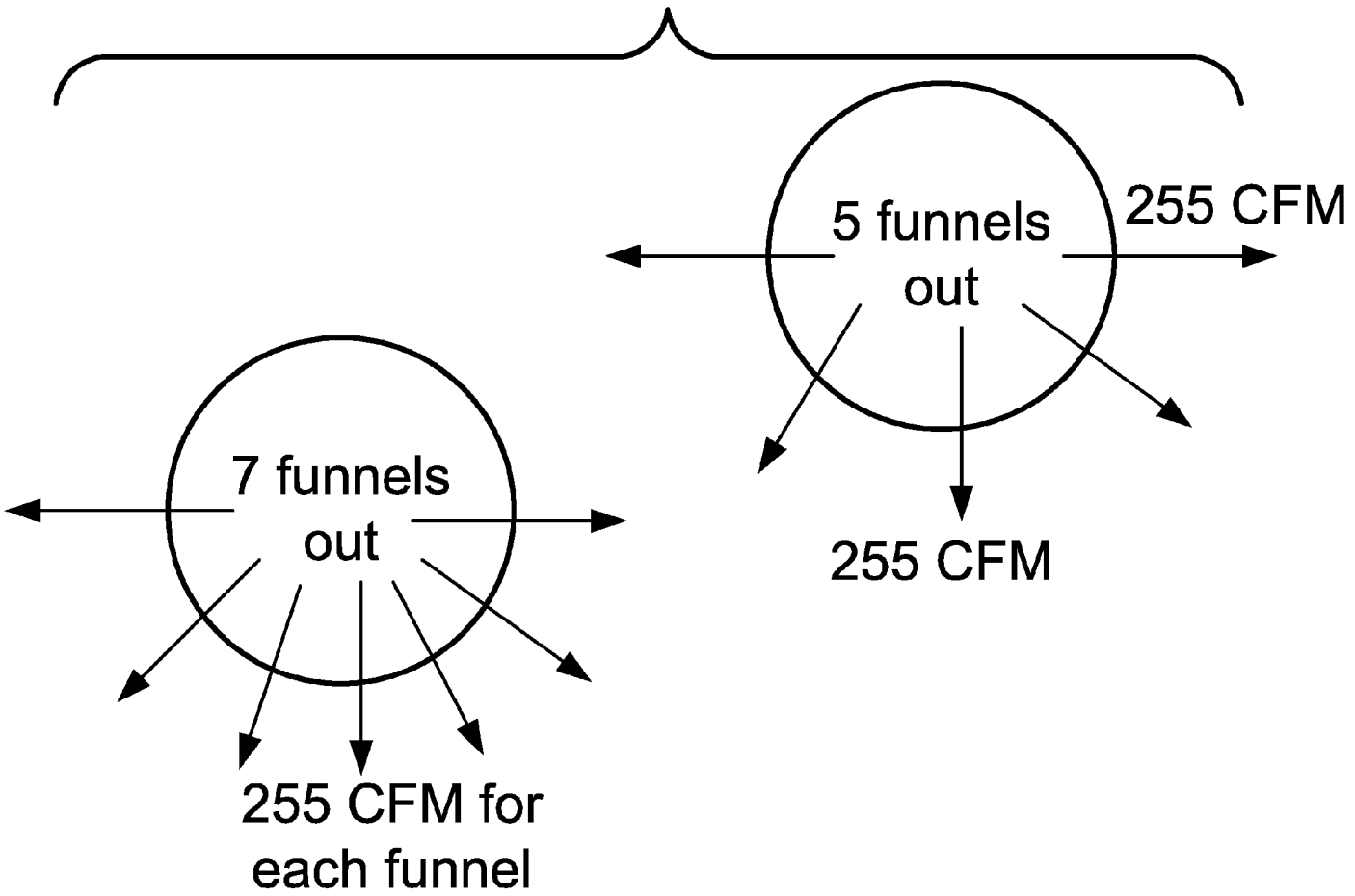
FIG. 14 shows the unit with various angles, with 5 and 7 funnels on a unit.
Figure 15:
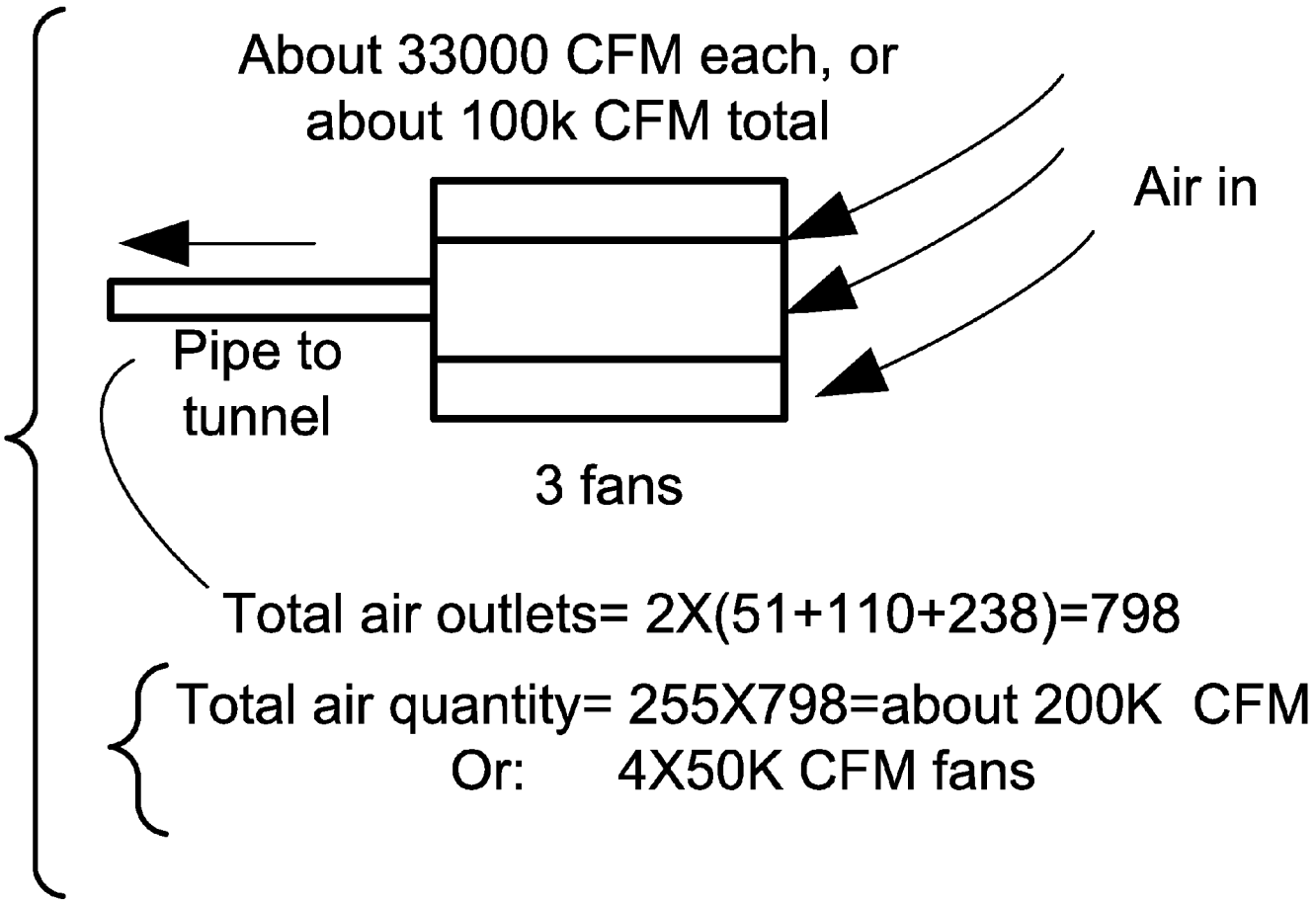
FIG. 15 shows the system with 3 parallel fans, adding to CFM output for air for all the outlets, from both sides of the tunnel, which can be implemented with other size fans, as well.
Figure 16:
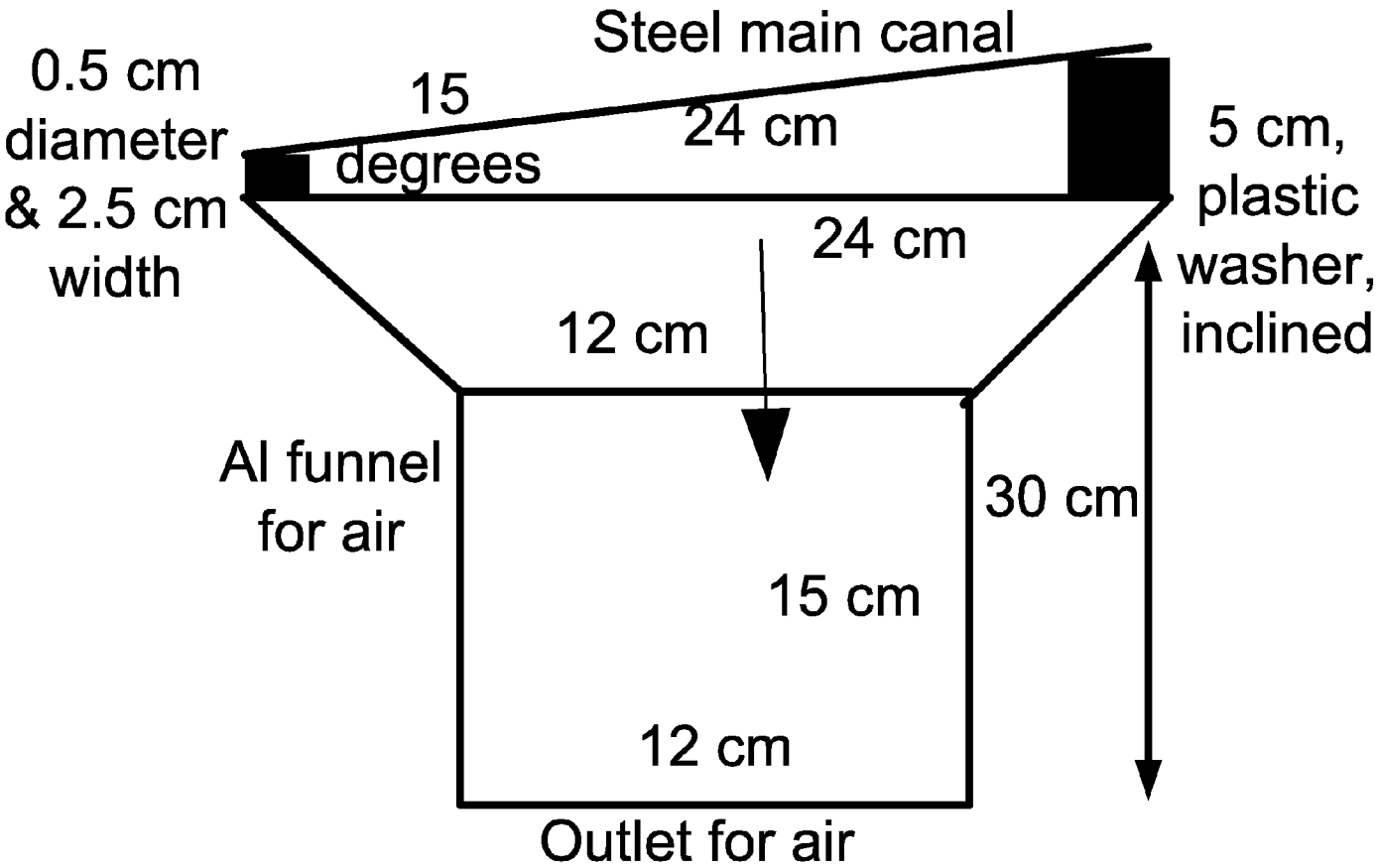
FIG. 16 shows the funnel with details for angle of 15 degrees.

FIG. 11 shows the funnel with various angles with hinge on a unit. FIG. 12 shows the fan with various filters for particles and chemicals, with soft bed vibration isolator at the end, for the duct (or pipe or canal) to the tunnel. FIG. 13 shows the funnels with various angles, with 3 funnels on a unit. FIG. 14 shows the unit with various angles, with 5 and 7 funnels on a unit. FIG. 15 shows the system with 3 parallel fans, adding to CFM output for air for all the outlets, from both sides of the tunnel, which can be implemented with other size fans, as well. FIG. 16 shows the funnel with details for angle of 15 degrees. All of the above are just examples for reader to better understand, but they are not limiting at all for dimension or materials or size or output or ratios.

The material can be from any metal or alloy or plastic or wood or synthetic material or the like. The fans can be in any form or energy supply or shape or direction or configuration. The tunnels can be any size or material or structure or location or purpose.

Any variations of the above teaching are also intended to be covered by this patent application.

The invention claimed is:

1. A tunnel air ventilation system installed on a tunnel, said system comprising:

two fan subsystems;

wherein each of said two fan subsystems are located at two ends of said tunnel, outside said tunnel, which are called a first fan subsystem and a second fan subsystem;

wherein each of said two fan subsystems comprises:

a filter, a vibration damping device, and at least one fan;

a main duct;

wherein said first fan subsystem is connected to said main duct;

wherein said main duct stretches from a first end of said tunnel to middle of said tunnel;

wherein said first fan subsystem pushes air into said main duct through length of said tunnel from said first end of said tunnel toward said middle of said tunnel;

multiple outlet units;

wherein said multiple outlet units are located on said main duct;

wherein each of said multiple outlet units has one or more air funnels for passing air into said tunnel;

wherein said tunnel is divided into three main regions;

wherein said three main regions comprise:

a) first entrance region and second entrance region, b) first side region and second side region, and c) a middle tunnel region;

wherein in said middle tunnel region, the density of number of said multiple outlet units on said main duct, per unit length of said main duct, is Dmiddle;

wherein in said first side region, the density of number of said multiple outlet units on said main duct, per unit length of said main duct, is Dside;

wherein in said first entrance region, the density of number of said multiple outlet units on said main duct, per unit length of said main duct, is Dentrance;

wherein said Dmiddle is larger than Dside, and said Dside is larger than Dentrance;

wherein direction of air flow inside said tunnel is symmetric with respect to center of said tunnel;

wherein for a first part of said middle tunnel region, located in close proximity of said middle of said tunnel, said one or more air funnels are positioned perpendicular to said tunnel's length axis; and wherein for any parts of said tunnel other than said first part of said middle tunnel region, said one or more air funnels are positioned inclined with respect to said perpendicular to said tunnel's length axis, pointing toward either said first end of said tunnel or a second end of said tunnel which is closer to said one or more air funnels.

2. The tunnel air ventilation system installed on a tunnel, as recited in claim 1, said system comprising:

a hinge, located on each of said multiple outlet units.

3. The tunnel air ventilation system installed on a tunnel, as recited in claim 1, wherein said filter is a fine filter.

4. The tunnel air ventilation system installed on a tunnel, as recited in claim 1, wherein said filter is a coarse filter.

5. The tunnel air ventilation system installed on a tunnel, as recited in claim 1, wherein said filter is a particle filter.

6. The tunnel air ventilation system installed on a tunnel, as recited in claim 1, wherein said filter is a sand filter.

7. The tunnel air ventilation system installed on a tunnel, as recited in claim 1, wherein said filter is a chemical filter.

8. The tunnel air ventilation system installed on a tunnel, as recited in claim 1, wherein said filter is a toxin filter.

9. The tunnel air ventilation system installed on a tunnel, as recited in claim 1, wherein said at least one fan is two or more fans.

10. The tunnel air ventilation system installed on a tunnel, as recited in claim 1, wherein said one or more air funnels are 3 funnels.

11. The tunnel air ventilation system installed on a tunnel, as recited in claim 1, wherein said one or more air funnels are 5 funnels.

12. The tunnel air ventilation system installed on a tunnel, as recited in claim 1, wherein said one or more air funnels are 7 funnels.

13. The tunnel air ventilation system installed on a tunnel, as recited in claim 1, wherein said one or more air funnels are odd number of funnels.

14. The tunnel air ventilation system installed on a tunnel, as recited in claim 1, wherein said one or more air funnels are even number of funnels.

15. The tunnel air ventilation system installed on a tunnel, as recited in claim 1, wherein said one or more air funnels have different directions.

16. The tunnel air ventilation system installed on a tunnel, as recited in claim 1, wherein said one or more air funnels have a shutter.

17. The tunnel air ventilation system installed on a tunnel, as recited in claim 1, wherein said one or more air funnels are made of plastic, metal, or alloy.

* * * * *